United States Patent [19]

Yamada et al.

[11] Patent Number: 4,622,085

[45] Date of Patent: Nov. 11, 1986

[54] METHOD OF AND APPARATUS FOR INJECTING AN ADHESIVE

[75] Inventors: Shingo Yamada; Kazuo Yamada, both of Nagoya, Japan

[73] Assignees: Ryowa Engineering Co., Ltd.; Nagoya General Bond Co. Ltd., both of Nagoya, Japan

[21] Appl. No.: 830,069

[22] Filed: Feb. 14, 1986

[51] Int. Cl.[4] ..... B32B 35/00

[52] U.S. Cl. ..... 156/94; 141/1; 141/114; 156/349; 156/578; 222/213; 222/215; 264/36; 425/13

[58] Field of Search ..... 141/1, 114; 156/94, 156/578, 349; 222/92, 105, 107, 213, 215, 632, 633; 264/36; 404/107; 405/269; 425/13; 427/140

[56] References Cited

U.S. PATENT DOCUMENTS

| | | | |
|---|---|---|---|
| 926,129 | 6/1909 | Murrie | 425/13 X |
| 3,255,788 | 6/1966 | Cook | 141/25 |
| 4,280,861 | 7/1981 | Schwartz | 156/94 X |
| 4,555,286 | 11/1985 | Orikasa et al. | 156/94 |
| 4,555,295 | 11/1985 | Orikasa et al. | 156/94 X |

*Primary Examiner*—Robert A. Dawson

*Attorney, Agent, or Firm*—Flehr, Hohbach, Test, Albritton & Herbert

[57] ABSTRACT

A plurality of injectors of the present invention are connected to a single source of a high-pressure gas to inject an adhesive material into cracks and delaminated sections of a building concurrently. Each injector has a front piece for attaching to a target area. An assembly comprising an inner container containing an adhesive material and an outer container enclosing the inner container is attached to a single cap to make a liquid-tight and gas-tight connection, respectively, and the cap is attached to the back of the front piece to make a liquid-tight connection by means of matchingly tapered surfaces. The inner container is elastic and has a concave bottom surface so that a high-pressure gas introduced into the space between the inner and outer containers can push out the adhesive material efficiently and smoothly from the inner container through the front piece.

10 Claims, 7 Drawing Figures

METHOD OF AND APPARATUS FOR INJECTING AN ADHESIVE

This invention relates to a method of and an apparatus for injecting a durable adhesive material into cracks in a structure or delaminated sections of such a structure caused by separation of mortar, tiles or the like.

When cracks appear on the walls of a structure such as a building, a common method of reinforcing such walls to protect them, for example, against rain is to attach injection pipes at appropriate intervals on the cracks and to inject therethrough an adhesive material such as epoxy resin after sealing the other surface areas. Many methods and different types of apparatus for such injection have been made available. According to Japanese Patent Publication (Tokkai) No. 57-89068, for example, a pressure buffer is disposed somewhere between the injection pipe and an injection hose such that the adhesive to be injected is temporarily pooled therein by the pressure applied on the adhesive material and that the pooled material is injected by the variations in the pressure inside the buffer. According to Japanese Patent Publication (Tokkai) No. 58-123971, on the other hand, injection is achieved by attaching to an unsealed section around a crack a cylindrical injector filled with an adhesive material and pressing a plunger slidably inside this cylindrical injector by the elastic force of certain rubber pieces. As a variation of the above, Japanese Patent Publication (Tokkai) No. 59-217872 teaches the use of a thin-film cartridge inserted into the aforementioned cylindrical injector and pressing a piston from the back of the cartridge by the force of a spring to effect the injection. According to Japanese Patent Publication (Tokkai) No. 59-217871, furthermore, a tube filled with an adhesive material is attached to an unsealed section around a crack and the injection of this adhesive material is achieved by squeezing the tube from outside by plate-like members sandwiching it.

With the devices disclosed in these publications, however, it is either impossible or very difficult to freely adjust the pressure to be applied in accordance with the physical characteristics of the adhesive material. Moreover, the pressure applied during an injection process cannot be maintained at a constant level and the viscosity of the adhesive has the tendency to increase as time elapses after the injection is started, but the applied pressure cannot be adjustably increased. Another difficulty with these devices is that injection cannot be effected simultaneously and uniformly through many injection pipes attached to cracked sections.

It is therefore an object of the present invention to provide an apparatus for and a method of injecting an adhesive material into cracks and delaminated sections of a structure efficiently and uniformly in an easily adjustable way. The above and other objects of the present invention are attained by attaching a number of injectors of the present invention on areas of interest and sending in a high-pressure gas from a common source through elongated vinyl tubes. Each injector comprises a front piece to be attached to a desired target area and two containers which can form tight connections therewith. The containers form a double-layered assembly, an external container enclosing therein an elastic, bellows-like air-tight inner container with a concave bottom surface. As a high-pressure gas is introduced into the space between the containers, the bellows is compressed and the adhesive material contained therein is uniformly and efficiently injected out.

The accompanying drawings, which are incorporated in and form a part of the specification, illustrate embodiments of the present invention and, together with the description, serve to explain the principles of the invention.

Figure 1:
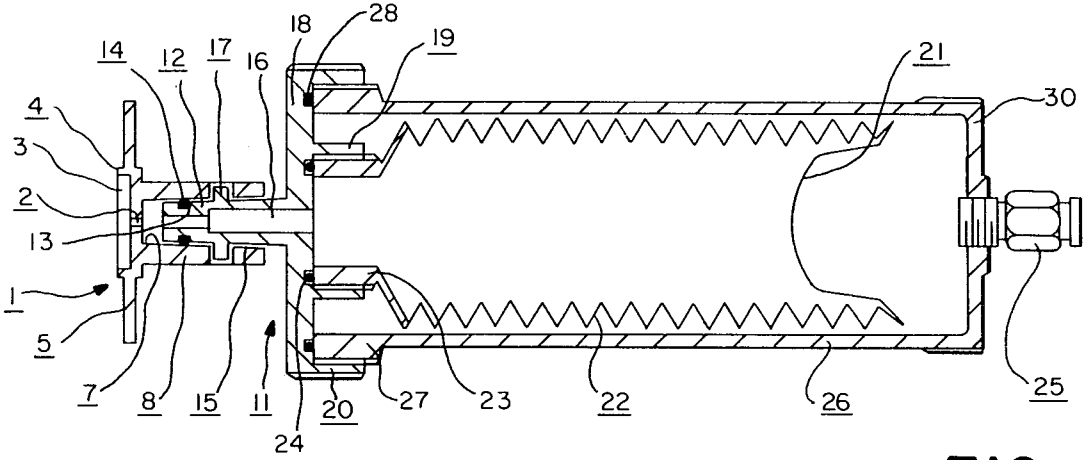
FIG. 1 is a longitudinal cross-sectional view of an injector according to the present invention.
Figure 4:
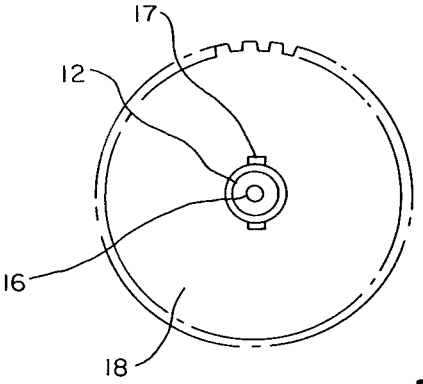
FIG. 4 is a plan view of the cap shown in FIG. 1.
Figure 3:
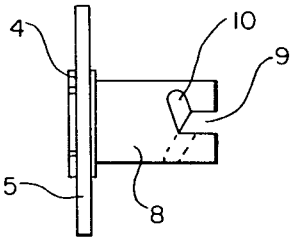
FIG. 3 is a side view of the front piece of FIG. 2.
Figure 2:
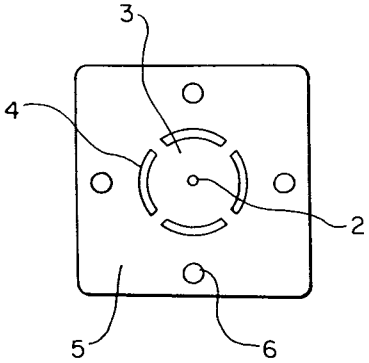
FIG. 2 is a plan view of the front piece shown in FIG. 1.

With reference to FIGS. 1, 2, 3 and 4, numeral 1 indicates a front piece to be attached to a cracked section of a ceiling, a wall or a floor of a building. Its surface which faces such a section has an injection opening 2 at the center of a flat section 3 and arcuate protrusions 4 disposed somewhat away from the center such that a quadrangular contact surface 5 formed like a flange lies between the surface of the flat section 3 and the plane defined by the ridges of the protrusions 4 as clearly illustrated in FIG. 1. The contact surface 5 is provided with a plurality of holes 6 as shown in FIG. 2. An adhesive material is intended to be placed on the contact surface 5, its thickness determined by the height of the protrusions 4. Its flow into the injection opening 2 is prevented by the protrusions 4 and its strength is increased by the adhesive material flowing into the holes 6. It is preferable that the contact surface 5 be neither totally flat nor smooth so that the effective area of contact with the adhesive is large and the front piece can be securely attached to a target area. The protrusions 4 may be connected together to form a single continuous circular wall.

The other side of the front piece 1 opposite from the contact surface 5 is in the form of a cylindrical tube 8 with a cavity 7 having a tapered inner wall. On the side wall of this cylindrical tubular member 8, two channels of several millimeters are cut at mutually symmetrical positions as indicated by numeral 9 in the direction parallel to its axis and then in the same rotational direction around the central axis of symmetry again for several millimeters as indicated by numeral 10.

Numeral 11 in FIG. 1 generally indicates a cap with a flange 18 and an injection cylinder 12 having therethrough an outlet 16 at the center. The injection cylinder 12, having a tapered outer wall 15 as shown, serves to be inserted to the tapered cavity 7 and to fit securely therein. Near the front end of the injection cylinder 12, there is a circumferential groove 13 and an O-ring 14 is fitted therein so that a liquid-tight contact can be formed between the injection cylinder 12 and the inner wall of the cavity. On the outer surface of the injection cylinder 12 between the groove 13 and the flange 18, there are two protruding pins 17 at symmetrical positions with respect to the axis of the cylinder 12 so as to correspond to and be engageable with the channels 9 and 10. In summary, when the cap 11 is inserted to the cavity 7 straight in the axial direction and the pins 17 reach the ends of the horizontal shallower parts 9 of the channels, the injection cylinder 12 is turned around so as to advance the pins 17 deeper into the deeper sections 10 of the channel and to form a liquid-tight contact between the O-ring 14 and the inner surface of the cavity 7.

On the opposite side of the cap 11 away from the injection cylinder 12, there are a smaller cylindrical protrusion 19 and a larger cylindrical protrusion 20 in a coaxial relationship with respect to each other and to the outlet 16. Female screws are provided to these protrusions 19 and 20. Numeral 26 indicates a cylindrical outer container with a wall made of a transparent material. It has a male screw provided at its front end 27 so as to engageably make an air-tight connection with the female screw on the larger cylindrical protrusion 20 with an O-ring 24 pressed against the flange 18. Numeral 22 indicates an inner container in the form of a bellows of a transparent and elastic material disposed inside the outer container 26, having a front end 23 provided with a male screw engaging with the female screw on the smaller cylindrical protrusion 19 to make a liquid-tight connection with another O-ring 28 pressed between the front end 23 and the flange 18. The inner container 22 has a concave bottom surface 21, and the outer container 26 has a back-end cap 30 provided with an inlet joint 25. As the inlet joint 25 may be used a commercially available one-touch joint of a well known type. It is preferable to have bellows of different sizes available for use under different conditions. For example, two sizes with capacities 50 cc and 100 cc for cracks and two with 500 cc and 1000 cc for delaminated sections should preferably be made available.

When use is made of injectors described above, the cracked sections of concrete ceilings, walls, etc. are washed and areas not to be covered by the injectors are sealed. In general, about three injectors are used per meter of a crack and about nine per $lm^2$ of a delaminated section. When a surface of a large area is worked on, therefore, hundreds of injectors may be used at once. for convenience, the method according to the present invention will be described below regarding one of many injectors of the type described above which may be used at once.

When an injector described by way of FIGS. 1–4 is used, an adhesive is put on the contact surface 5 of the front piece 1 such that its top surface will slightly protrude above the ridge of the protrusions 4. The front piece 1 is then applied to a target surface and pressed against it. The excess portion of the adhesive above the projections 4 is pressed outwardly by the arcuate protrusions 4 and spills out in part through the holes 6. Only a small portion flows into the flat section 3 through the gaps between the protrusions 4 and this portion will mostly remain in the flat section 3 without flowing into the injection opening 2. The front piece 1 thus becomes attached to the target area by the large amount of adhesive material left between the target surface and the contact surface 5.

In the meantime, the corresponding inner container 22 is filled with an epoxy-type adhesive and its front end 23 is engaged with the smaller cylindrical protrusion 19 on the cap 11 to make a liquid-tight connection therewith by inserting the O-ring 24 at the bottom of the female screw of the smaller cylindrical protrusion 19. Thereafter, the O-ring 28 is inserted at the bottom of the female screw of the larger cylindrical protrusion 20, and the outer container 26 is connected to the cap 11 by engaging the male screw on its front section 27 with the female screw of the larger cylindrical protrusion 20. The assembly thus completed is then inserted through the tapered cavity 7 of the cylindrical tube 8 of the front piece 1 which is already attached to the target surface. The pins 17 on the injection cylinder 12 of the cap 11 are engaged in the channels 9 and 10 as explained above, until the assembly is drawn towards the front piece 1 and the O-ring 14 becomes pressed against the inner wall of the cavity 7 to form a liquid-tight connection.

Figure 5:
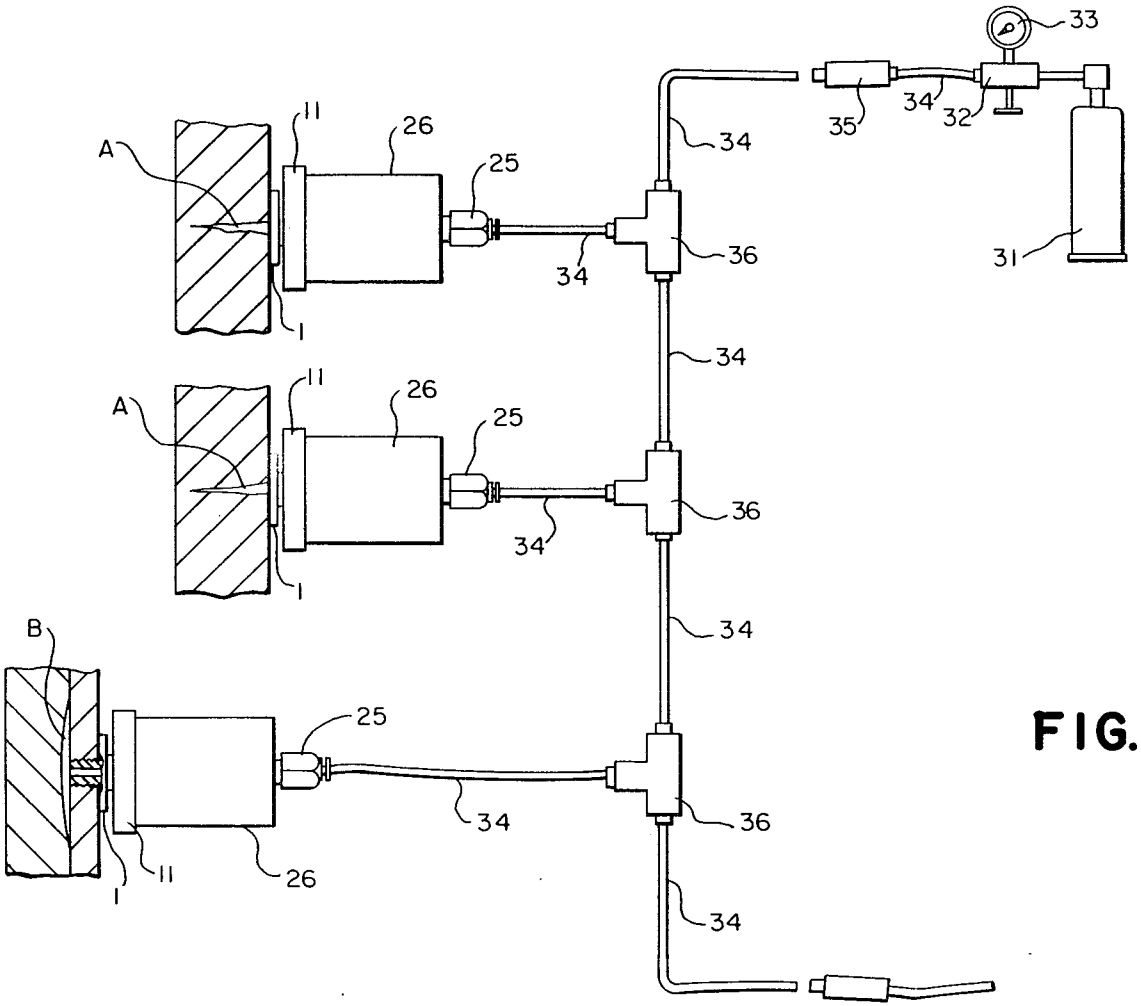
FIG. 5 is a schematic drawing which shows how a number of injectors of the type shown in FIG. 1 are typically connected.

When a large number of injectors are thus prepared, they may be connected to a common pressure source to be operated simultaneously. Reference being made to FIG. 5 where a method of such connection is schematically illustrated, numeral 31 indicates a high pressure gas container connected through a pressure control means 32 with a pressure gauge 33 and elongated vinyl tubes 34 to the individual injectors. The pressure control valve 32 is generally set below 12 $kg/cm^2$. Work may be completed satisfactorily even with a low pressure in the range of 0.2–3 $kg/cm^2$. Three-way one-touch joints 36 may be strategically inserted as shown in FIG. 5 and the vinyl tubes 34 are connected to the individual injectors through the inlet joints 25. Couplers may be alternatively used at these joints. An air compressor may be used instead of the high pressure container 31.

When a valve in the control means 32 is opened, high pressure air enters each connected injector through the inlet joint 25 and compresses the bellows-shaped inner container 22 inside the outer container 26 not only from the bottom surface 21 but also from the side surfaces. Since the hydrostatic forces acting from the bottom surface 21 and sideways on the bellows-like body of the inner container 22 are balanced, the inner container 22 does not undergo any undesirable deformation and the adhesive material inside the inner container 22 is pushed out through the outlet 16 and the injection opening 2 to the cracked section. The concave shape of the bottom surface 21 helps the adhesive inside the inner container 22 to be effectively pushed outside as the inner container 22 is compressed by pressure from outside. If the viscosity of the adhesive increases with time, the pressure control means 32 should be adjusted with reference to the pressure gauge 33.

Figure 6:
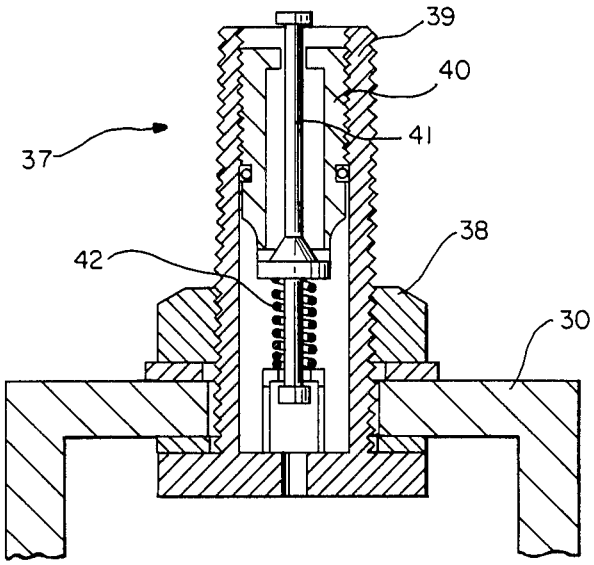
FIG. 6 is a cross-sectional view of an inlet joint for the injector of FIG. 1 according to another embodiment of the present invention.

FIG. 6 shows the structure of a plug with a check valve 37 which may be used as the inlet joint shown by numeral 25 in FIG. 1. The plug 37 is of the well-known structure used for the air plug of an automobile tire. A tubular member 39 is securely connected to the backside cap 30 by means of a nut 38. A valve plug 40 is engagingly screwed inside the tubular member 39 and its end surface is adapted to function as the valve seat. A valve shaft 41 is slidably inserted through the center of the valve plug 40. A spring 42 is provided so as to constantly press the valve against the valve seat to prevent the high-pressure gas from leaking through from inside. In this situation, the end of the shaft 41 protrudes slightly above the end surface of the tubular member 39.

Figure 7:
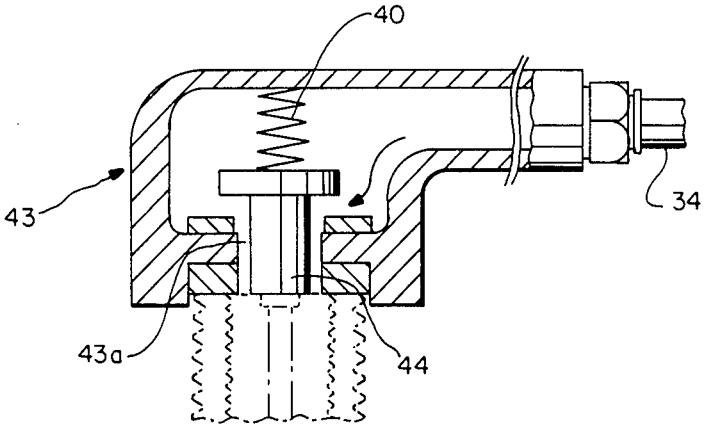
FIG. 7 is a cross-sectional view of a means for injecting high-pressure air through the inlet joint shown in FIG. 6.

A means 43 of a well-known type for injecting a high pressure gas such as air through the plug of FIG. 6 is shown in FIG. 7 wherein numeral 44 is a valve for pressing the valve shaft 41 through the tubular member 39. The valve 44 is slidably disposed and adapted to keep the gas supply entrance 43*a* closed by the force of a spring 40. This means 43 is connected to a one-touch joint 36 of FIG. 5 via a long vinyl tube 34. If the plug with a check valve 37 is used instead of an ordinary inlet joint 25, air can be supplied to the individual injectors of FIG. 5 independently.

As explained above in detail, the injector and the method of using the same according to the present invention are characterized in that a deformable elastic container of an adhesive is compressed uniformly by a high-pressure fluid so that the adhesive can be smoothly pushed out. It is thus possible not only to freely adjust the pressure according to the physical properties of the adhesive but also to maintain the pressure at a desired level. Moreover, any number of such injectors required for the job can be added and pressure can be applied uniformly through them. If the viscosity of the adhesive changes with time, a pressure control means can be operated to change the pressure level during the operation. In the case of cracks, in particular, forces between neighboring cracks can be balanced so that injection can be effected efficiently and thoroughly. Even if one of the many injectors being used together as shown in FIG. 5 becomes separated from the wall, it will be prevented from falling because the injectors tend to support one another by the vinyl tubes 34. The joint between the front piece and the container of adhesive is made easy by means of tapered surfaces between them. The bottom surface of the bellows is made concave in such a way that the content of the inner container can be pushed out efficiently.

The foregoing description of the present invention has been presented for purposes of illustration and description. It is not intended to be exhaustive or to limit the invention to the precise form disclosed, and obviously many modifications and variations are possible in light of the above teaching. Any minor changes and modifications that may be apparent to a person skilled in the art are intended to be within the scope of this invention.

What is claimed is:

1. A method of injecting an adhesive material into a cracked or delaminated section of a structure comprising the steps of attaching a front piece to a target area, engagingly connecting a deformable bag-like container containing an adhesive material to said front piece, and sending a fluid with an adjustably controlled pressure into an external container which encloses said bag-like container therein and is connected to said front piece in an air-tight manner so as to apply said pressure uniformly to said bag-like container, to compress said bag-like container and to inject said adhesive material out of said bag-like container through said front piece.

2. The method of claim 1 further comprising the step of attaching a plurality of other front pieces to a plurality of other target areas, engagingly connecting to said other front pieces a plurality of other bag-like containers, and sending said fluid to other external containers similarly containing said other bag-like containers and connected to said other front pieces so as to inject adhesive materials at said other target areas concurrently.

3. The method of claim 1 wherein said step of connecting a deformable bag-like container includes the step of selecting one out of a set of available bag-like containers of different sizes.

4. The method of claim 1 wherein said step of attaching a front piece comprises attaching an adhesive material on a front surface of said front piece and pressing said front piece against said target area.

5. An injector comprising a front piece with an injection hole therethrough having a front surface and a back surface, said back surface having a cylindrical tubular member, said cylindrical tubular member having an outwardly tapered inner surface, a cap with an outlet opening therethrough having a front side and a back side, said front side including a tapered cylindrical protruding section which serves to form a liquid-tight connection with said tapered inner surface, said back side comprising a smaller cylindrical protrusion and a larger cylindrical protrusion, a deformable inner container having a concave bottom surface, which serves to contain an adhesive material and is connectable to said smaller cylindrical section to form an air-tight connection with said cap, and an outer container which encloses said inner container therein and engages with said larger cylindrical protrusion to form an air-tight connection with said cap, said outer container having a gas inlet for introducing pressured fluid thereinto.

6. The injector of claim 5 wherein said cylindrical section has protruding pins, said cylindrical tubular member having channels such that said protruding pins slide along said channels as said cylindrical section is inserted inside said cylindrical tubular member.

7. The injector of claim 5 wherein said smaller and larger cylindrical protrusions are adapted to engage with said inner and outer containers respectively by screw mechanisms.

8. The injector of claim 5 wherein said front piece has on said front surface arcuate protruding pieces away from said injection hole, said front piece further including a contact surface extending outside said arcuate protruding pieces, said contact surface being lower than said arcuate protruding pieces.

9. The injector of claim 5 wherein said gas inlet includes a one-touch joint.

10. The injector of claim 5 wherein said gas inlet includes a plug with a check valve.

* * * * *